US010278527B2

(12) United States Patent
Hayward

(10) Patent No.: US 10,278,527 B2
(45) Date of Patent: May 7, 2019

(54) PORTABLE BEVERAGE HOLDER

(71) Applicant: Carl Hayward, Conyers, GA (US)

(72) Inventor: Carl Hayward, Conyers, GA (US)

( * ) Notice: Subject to any disclaimer, the term of this patent is extended or adjusted under 35 U.S.C. 154(b) by 45 days.

(21) Appl. No.: 15/628,805

(22) Filed: Jun. 21, 2017

(65) Prior Publication Data

US 2018/0368600 A1 Dec. 27, 2018

(51) Int. Cl.
*A47G 23/02* (2006.01)
*A45F 5/02* (2006.01)
*A45F 5/00* (2006.01)

(52) U.S. Cl.
CPC ..... *A47G 23/0216* (2013.01); *A45F 5/021* (2013.01); *A45F 2005/008* (2013.01); *A45F 2200/0583* (2013.01)

(58) Field of Classification Search
CPC ..... A47G 23/00–0216; A45F 5/021; A45F 2200/0583; A45F 2005/008
USPC ..... 220/737–743, 639, 645, 651; 248/311.2, 248/214, 309.1; 224/224.7, 679, 677
See application file for complete search history.

(56) References Cited

U.S. PATENT DOCUMENTS 2,926,879 A * 3/1960 Dietrich ..... A47G 23/0225 224/406
3,633,863 A * 1/1972 Abbey ..... A47G 23/0216 215/394
4,697,780 A * 10/1987 Wenkman ..... F16M 13/02 248/311.2
5,056,696 A 10/1991 Lahr
5,944,238 A 8/1999 Stark
6,010,104 A * 1/2000 Hanson ..... A47C 1/16 248/309.1
6,019,335 A * 2/2000 Sehati ..... A45F 5/02 224/148.4
D423,884 S 5/2000 Greenwood
6,227,510 B1 * 5/2001 McMullen, Sr. ..... A47C 7/68 248/230.5
6,305,656 B1 * 10/2001 Wemyss ..... A47G 23/0216 206/5
8,033,518 B2 10/2011 Schuchman
8,690,166 B2 * 4/2014 Peota ..... B62B 3/1472 220/482
8,777,307 B2 * 7/2014 Nelson ..... A47C 7/70 297/188.14

(Continued)

FOREIGN PATENT DOCUMENTS

CA 2514150 A1 10/2006

OTHER PUBLICATIONS

Amazon.com: Give'r Hands Free Neck Coozie Beverage Insulator—4 Pack (Red, White, Blue): Kitchen & Dining, https://www.amazon.com/Giver-Hands-Coozie-Beverage-Insulator/dp/B01H1FMU0, May 16, 2017.

*Primary Examiner* — Kareen K Thomas
(74) *Attorney, Agent, or Firm* — Kristin M. Crall; Kilpatrick Townsend & Stockton LLP

(57) ABSTRACT

Embodiments provide a portable beverage holder and carrier system. The system may be worn on a user's waist or belt in a hands-free manner. An interior space of a beverage holding portion of the portable beverage holder features at least one prong for secure positioning of a beverage container. The system features an adjustable rotator that allows movement and then locking of the beverage holding portion. The system may also include a removable canister for holding additional items.

16 Claims, 6 Drawing Sheets

(56) References Cited

U.S. PATENT DOCUMENTS

| | | | | |
|---|---|---|---|---|
| 9,642,485 | B2 * | 5/2017 | Kuznicki, Jr. | A47G 23/0225 |
| 9,848,691 | B1 * | 12/2017 | Pedersen | F16M 13/022 |
| 2004/0108346 | A1 | 6/2004 | Pablo | |
| 2005/0236531 | A1 * | 10/2005 | Joeckel | A47G 21/145<br>248/133 |
| 2008/0128571 | A1 * | 6/2008 | Dostaler | A47G 23/0225<br>248/229.13 |
| 2010/0294819 | A1 | 11/2010 | Sentell | |
| 2014/0252820 | A1 * | 9/2014 | Botello | F16M 13/02<br>297/188.04 |
| 2014/0263381 | A1 | 9/2014 | Gareri et al. | |
| 2015/0069075 | A1 * | 3/2015 | Robbins, III | A47G 23/0216<br>220/737 |
| 2015/0274300 | A1 * | 10/2015 | Moore | B60N 3/102<br>224/401 |

* cited by examiner

PORTABLE BEVERAGE HOLDER

FIELD OF THE DISCLOSURE

Embodiments of the present disclosure relate generally to a portable beverage holder and carrier system. The system may be worn on a user's waist or belt in a hands-free manner.

BACKGROUND

There are some situations in which carrying beverages in a conventional manner is inconvenient. For example, during outdoor events such as food festivals, a user's hands may be full due to holding a plate or other items. In other examples, a user may be carrying packages, carrying a child, or otherwise prefer to have his/her hands unencumbered by a beverage, but to still have the beverage easily accessible within arm's reach.

There are belt-mounted/clip-on beverage holders available, but such devices do not securely maintain the beverage in place. Such devices similarly fail to provide options for alternate accessories. Additionally, such devices are often bulky and heavy, such that they potentially weigh the user down.

BRIEF SUMMARY

Embodiments provide a portable beverage holder and carrier system. The system may be worn on a user's waist or belt in a hands-free manner. An interior space of a beverage holding portion of the portable beverage holder features at least one prong for secure positioning of a beverage container. The system may also feature an adjustable rotator that allows movement and then locking of the beverage holding portion. The system may also include a removable canister for holding additional items.

In one example, there is provided a portable beverage holder unit, comprising: a beverage holding portion comprising an upper frame, a plurality of side portions, and a base; at least one side portion in the plurality of side portions comprising an inner prong; an adjustable rotator; and an attachment feature for securing the portable beverage to a user, wherein the adjustable rotator allows the beverage holding portion to be positioned at a desired angle with respect to the attachment feature and locked in place. The inner prong can be depressed upon insertion of a beverage container into the beverage holding portion. The adjustable rotator can be a ratchet system. In a specific example, the ratchet system can include a gear element with teeth and a pin element configured to be engaged within a set of teeth in order to secure the beverage holding portion at the desired angle.

It is possible to provide the beverage holder unit with a canister accessory. The canister accessory can have a securement feature and a corresponding securement feature on at least one side rail of the plurality of side rails. In one example, the securement feature includes rails and the corresponding securement feature comprises a T-rail. In another example, the canister accessory may be integrally formed along a side portion of the beverage holding portion.

DETAILED DESCRIPTION

Embodiments of the present invention provide a portable beverage holder that allows hands-free carrying of a beverage container. The beverage holder may find particular use in instances where the user would like to have easy access to the beverage, but maintain his/her hands free and in an unencumbered state. The lightweight and compact design allows the beverage holder to be easily carried, as well as stored and transported when not in use.

Figure 1:
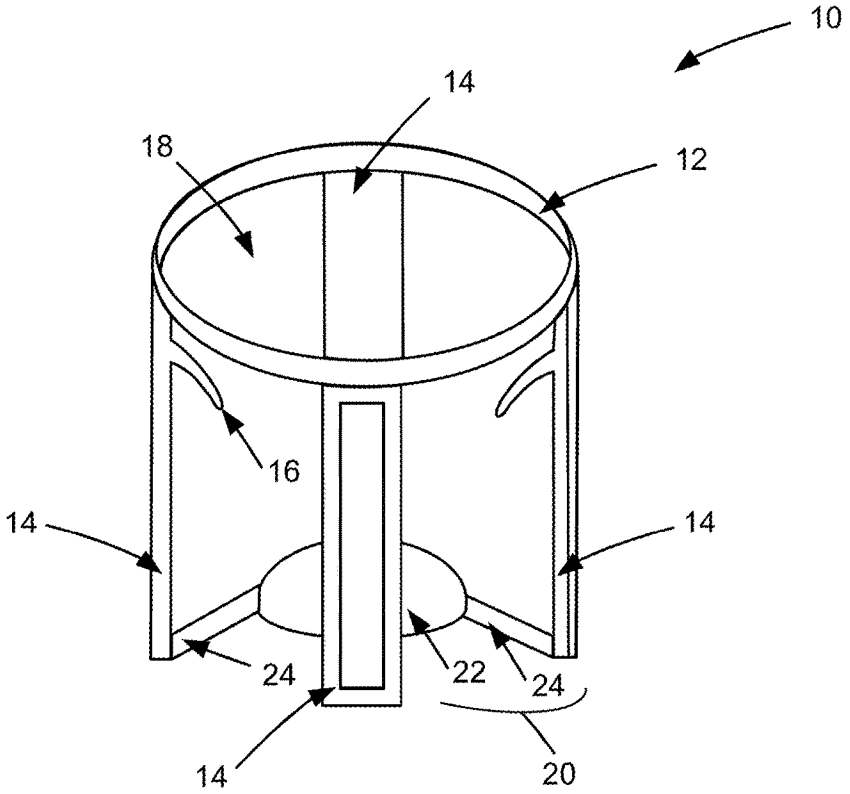
FIG. 1 shows a perspective view of a portable beverage cup holder.

As illustrated by FIG. 1, the portable beverage holder unit 10 is formed as having a lightweight and open construction. In one example, the unit has an upper frame 12 having a circular configuration. Extending down from the upper frame 12 are side portions 14. Any number of side portions 14 may be provided, as long as the side portions sufficiently support the container to be held. In a specific example, three or four side portions 14 are provided. The number of side portions 14 may be optimized in order to lower weight and cost of the unit, but to also provide desirable support. The upper frame 12 and side portions 14 collectively form a beverage holding portion 40.

As illustrated, at least one of the side portions 14 has an inner prong 16. The inner prong 16 is intended to have a flexibility that causes it to extend into the interior space 18 created between the upper frame 12 and the side portions 14 when a beverage is not being held. When a beverage container is positioned in the interior space 18, pressure from the container causes inner prong 16 to become at least slightly inwardly depressed. Because the inner prong 16 is biased toward the upward direction, it applies a slight pressure to the beverage container to hold it snugly into place. When the beverage container is removed, the inner prong 16 moves back to its initial position, biased upwards. This inner prong 16 movement may be accomplished via use of a flexible plastic material. In another example, inner prong 16 movement may be accomplished by use of a spring (e.g., a spring hinge or a leaf spring) positioned between the inner prong 16 and the side portion 14 on which the inner prong 16 is positioned. In one example, each of the side portions 14 has an inner prong 16. In another example, an inner prong 16 is provided on every other side portion 14.

One benefit of the design described is that the side portions 14 define open spaces therebetween. This helps provide the lightweight design of the portable beverage holder unit 10.

The base 20 of the portable beverage holder unit 10 may be formed as a lower support 22 held in place by extensions 24 of side portions 14. The lower support 22 is shown as a circular support, but it should be understood that any shape is possible and considered within the scope of this disclosure. It is also possible to provide a counterweight at the bottom of the beverage holder unit 10. In one example, the counterweight may be positioned in line with or otherwise secured to the lower support 22. The counterweight may be provided in order to help increase the center of gravity of the unit 10. Providing the lower portion 22 as the heaviest area of the unit 10 can help provide stabilization. This feature may become useful if the unit is used in a "swivel" option, as described further below.

Figure 2:
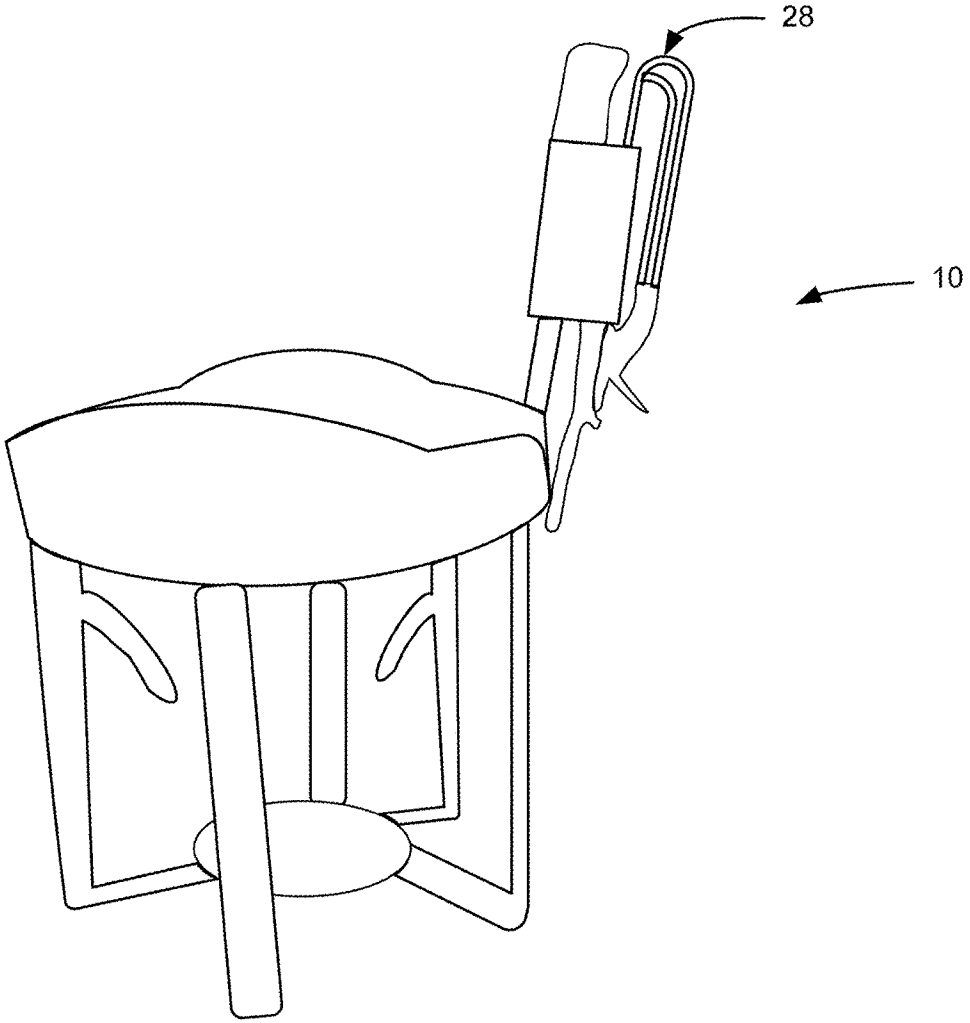
FIG. 2 shows a side perspective view of a portable beverage cup holder having an attachment feature.
Figure 3:
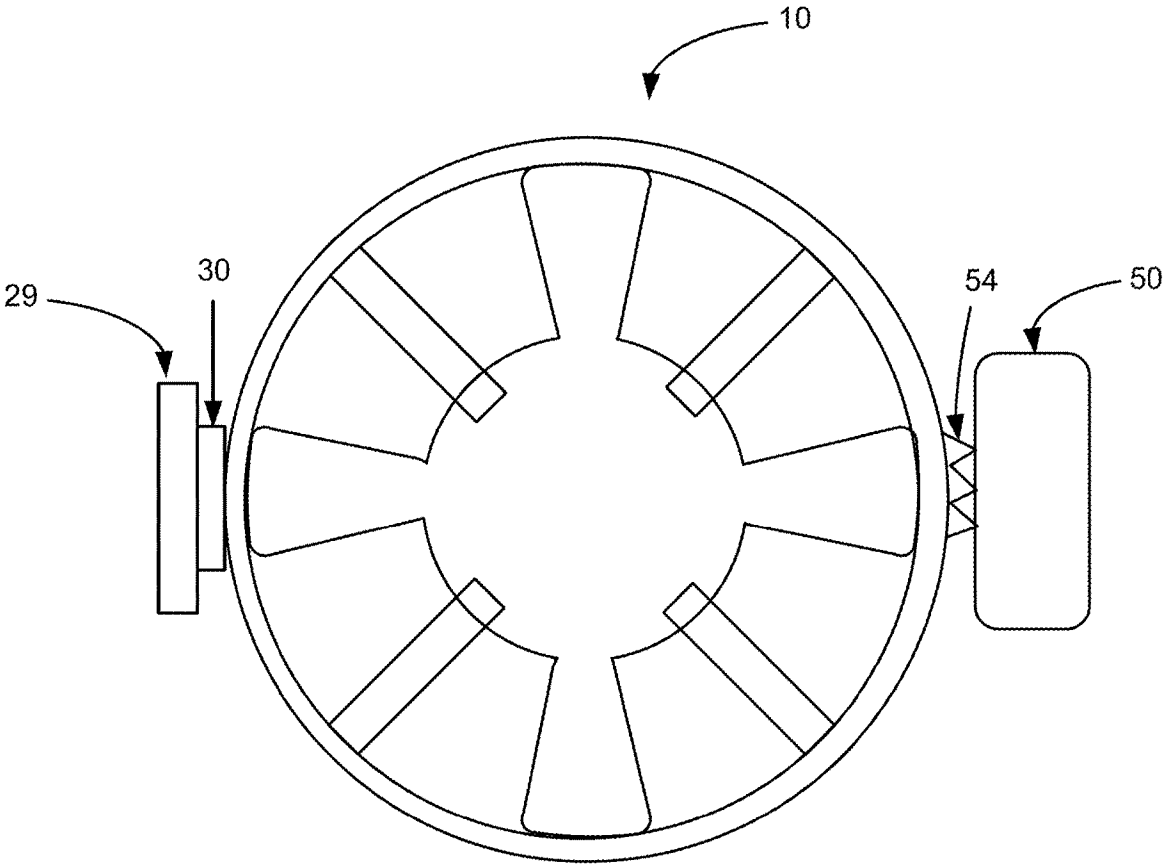
FIG. 3 shows a top plan view of a portable beverage cup holder having an attachment feature and an accessory.
Figure 5:
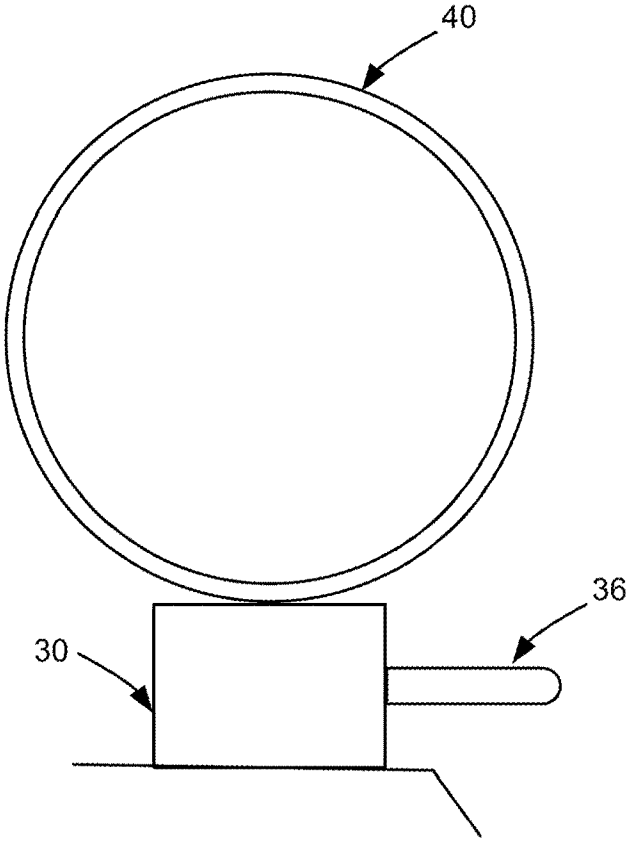
FIG. 5 shows a top plan view of the portable beverage cup holder of FIG. 4.
Figure 4:
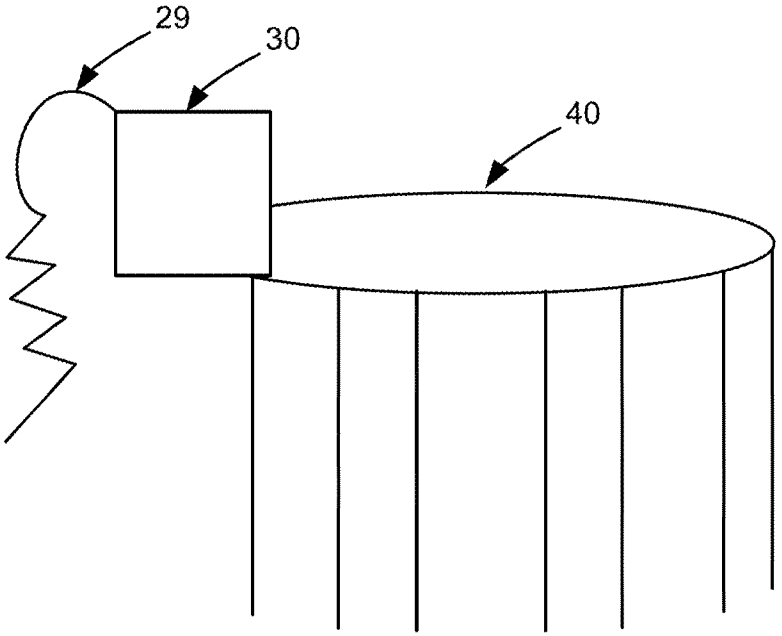
FIG. 4 shows a side perspective view of a portable beverage cup holder having an attachment feature with an adjustable rotator.
Figure 7:
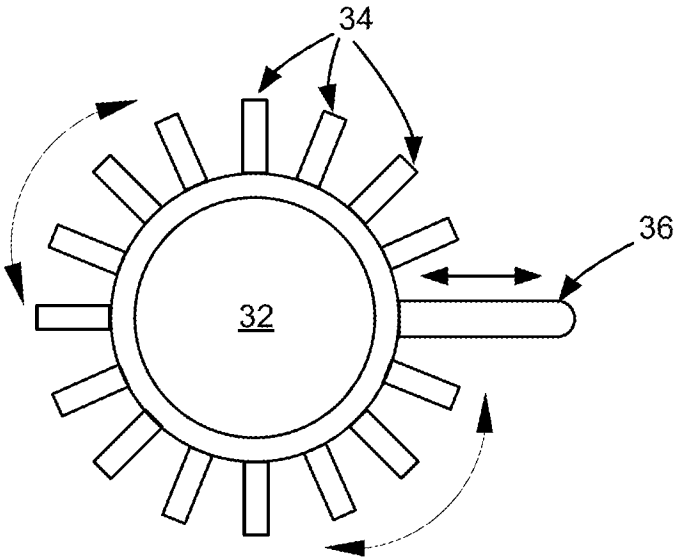
FIG. 7 shows a top plan view of the adjustable rotator of FIG. 7 with the pin secured.
Figure 6:
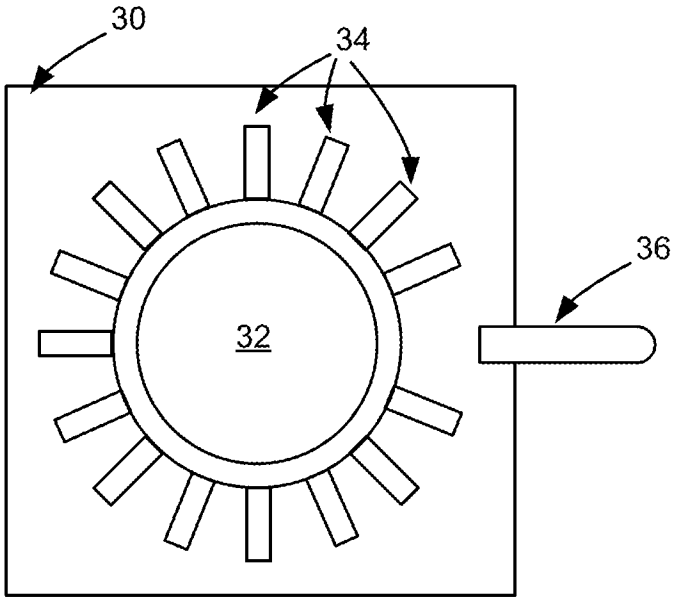
FIG. 6 shows a top plan view of an adjustable rotator with the pin released.
Figure 11:
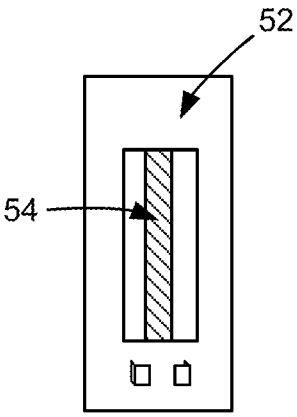
FIG. 11 shows a rear plan view of the canister of FIG. 8.
Figure 10:
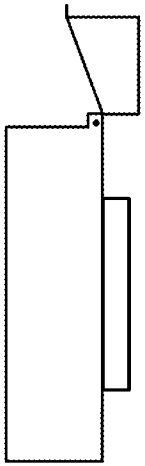
FIG. 10 shows a side plan view of the canister of FIG. 8 with the lid open.
Figure 9:
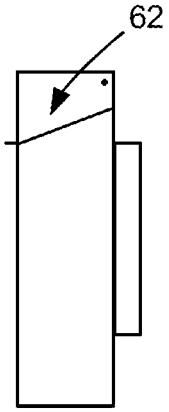
FIG. 9 shows a side plan view of the canister of FIG. 8 with the lid closed.
Figure 8:
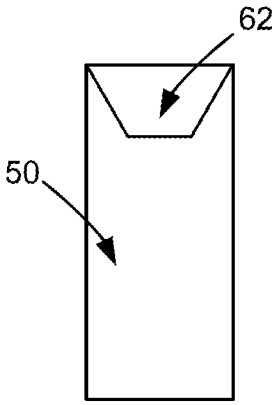
FIG. 8 shows a front plan view of an optional canister.

The portable beverage holder unit 10 is also provided with an attachment feature 26. In one example, the attachment feature 26 may be a hook 28 or a clip 29 that attaches to a user's trousers or belt. The attachment feature 26 may be a spring-loaded hook or clip. The attachment feature 26 may be an alligator type clip. One example of a hook 28 embodiment is illustrated by FIG. 2. One example of a clip 29 embodiment is illustrated by FIGS. 3 and 4. In one specific example, the attachment feature 26 may be a clip 29 that is associated with an adjustable rotator 30, such as a ratchet system. The ratchet system may be used in order to lock the beverage holding portion 40 of the unit 10 in place at a particular angle. One example of such an adjustable rotator ratchet system 30 is illustrated by FIGS. 5-7.

The ratchet system 30 may include a gear element 32 with external teeth 34 and a pin element 36. In use, the pin element 36 remains clear of the gear teeth 34 while the beverage holding portion 40 is adjusted to the desired angle. Side to side movement of the beverage holding portion 40 causes consequent movement of the gear element 32. Once the beverage holding portion 40 has been adjusted as desired, user may release pin element 36. Release of the pin element 36 locks a pin end 38 in between one set of the gear teeth 34. The beverage holding portion 40 is locked in place. If the pin element 36 is disengaged, the beverage holding portion 40 is allowed to swivel with respect to the clip 29. It is possible to provide a pin element 36 locking position that may be maintained, as well as a pin element 36 release position that may be similarly maintained, depending upon user preferences. Once the angle of the beverage holding portion 40 with respect to the clip 29 has been set, the user may secure the clip onto his or her trousers or belt. In another embodiment, it is possible to provide the pin element 36 as having a secure disengaged option, such that the unit 10 is allowed to swing freely, whether the user is walking or standing. The user may, at any time, decide to re-engage the pin element 36 so that the ratchet system 30 then locks the unit 10 at a desired angle.

In an alternate embodiment, the adjustable rotator may be a gyroscope that can allow the beverage holding portion 40 to consistently remain in an upright position, regardless of the angle of the corresponding attachment feature 26.

The portable beverage unit 10 may include an optional accessory. One example of an optional accessory is an attachable canister 50 or compartment that may function as a napkin or other item holder. An alternate example of an optional accessory is a foam insulation feature 70.

Figure 12:
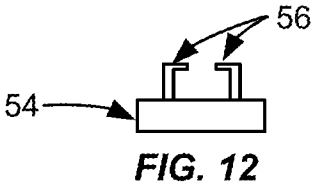
FIG. 12 shows a top plan view of one embodiment of a securement feature for securing the canister to the beverage holder.
Figure 13:
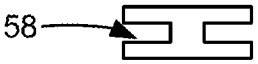
FIG. 13 shows a top plan view of one embodiment of a corresponding securement feature for securing the canister to the beverage holder.

For the canister 50 accessory option, the canister 50 is secured to the beverage holding portion 40 and functions to hold napkins, straws, gum, a cell phone, cigarettes, money, or any other small items that are useful to have nearby, but hands-free. Exemplary options are illustrated by FIGS. 8-11. In one specific example, the canister 50 has a rear wall 52 with a securement feature 54. The figures illustrate the securement feature 54 may be a set of rails 56 that are designed to cooperate with a corresponding T-rail 58 on the side portions 14. FIG. 12 illustrates a top view of a set of rails 56, and FIG. 13 illustrates a top view of a corresponding T-rail 58. In use, the user may secure each rail in the set of rails 56 such that each rail 56*a*, 56*b* is received by the side channels 60*a* and 60*b* of the T-rail 58. It should be understood that the rear wall 52 of the canister 50 may be provided with the T-rail 58 and that the side portions 14 may be provided with the set of rails 56. In either embodiment, the canister 50 is allowed to slide up and down along the side portions 14 in order to position the canister 50 with respect to the beverage holding portion 40. A stop may be provided at the bottom of each T-rail 58 in order to secure the canister 50 in place. It is possible to provide each of the side portions 14 with a securement feature that corresponds to the securement feature 54 of the canister 50. This would allow multiple canisters 50 to be used with the portable beverage holder unit 10. Differently sized and shaped canisters 50 may be provided. In an alternate example, the securement feature 54 may be provided by a magnetic securement, by a hook and loop (e.g., VELCRO®) securement, or via adhesive strips. It is further possible for the canister 50 to be integrally attached to or otherwise formed integrally with the unit 10 (with the canister 50 and unit 10 forming a single piece) such that the canister 50 is not removable therefrom.

The canister 50 may be provided with a lid 62, which can safely maintain the contents of the container in the enclosed canister 50. The lid 62 may be provided with a lip 64 that allows easy access for the user to open and close the lid 62. The lid 62 may be hingedly secured to the remainder of the canister body 50. In another example, the lid 62 may snap on and off of the canister body 50.

An alternate accessory that may be provided is an insulation feature. It is possible to provide an insulation element that is similarly sized to the interior space 18 of the beverage holding portion 40, but slightly smaller. The insulation feature may be fit into the beverage holding portion 40 in order to maintain a particular warm or cold condition of the beverage being held. In an alternate embodiment, the insulation feature may be configured to be positioned on an external surface of the beverage holding portion 40, such that the beverage holding portion 40 is encased or enveloped by the insulation feature. The insulation feature may be held in place via hook and look material such as VELCRO®, snap fit, friction fit, or secured by any other appropriate manner. The insulation feature may be a foam material, a neoprene material, a plastic material, a metal material, or any other material that can maintain a temperature of a beverage being held by the unit 10.

The upper frame 12 is generally provided as a solid ring as shown, but it should be understood that it is possible for upper frame 12 to be adjustable. If adjustable, the upper frame 12 may ratchet open and closed to provide larger and smaller diameters in order to accommodate variously sized beverage containers. Additionally, the side portions 14 are generally provided as having a set and constant length. However, it should be understood that it is possible for side rails to be similarly adjustable. They may ratchet higher or lower in order to accommodate taller or shorter beverage containers.

In one example, the portable beverage holder may be manufactured of a plastic material. Exemplary plastic materials include but are not limited to polystyrene, polyethylene, polyvinyl chloride (PVC), any other appropriate material, or any combination thereof. If manufactured of plastic, the plastic material may be extruded or injection molded. In another example, the portable beverage holder may be manufactured of an aluminum, an aluminum alloy, carbon fiber, stainless steel, any other appropriate metal material, or any combination or alloy thereof. If produced from aluminum, the component may be an aluminum alloy. Elements commonly alloyed with aluminum are zinc, manganese, copper, silicone, nickel, or combinations thereof. The aluminum may be formed by casting, rolling, drawing and/or forging. In all examples, the material may be selected in order to optimize strength, corrosion resistance, hardness, specific gravity, weight, and cost.

If provided, the optional canister may be manufactured out of any of the above referenced materials. If provided, the foam insulation feature may be manufactured out of styrofoam, neoprene, or any other appropriate material.

The portable beverage holder described herein provides ease of use, convenience, practicality, effectiveness, durability, and time savings. It is lightweight, compact in size, portable, and provides adjustability. It provides the user a quick and simple way to carry a hot beverage can, bottle, cup, glass, or other container. Instead of carrying the container by hand, the user secures the portable beverage holder to the waist area on a pair of trousers or a belt, preventing beverages from slipping from the user's grip. Use of the portable beverage holder described herein prevents the user from having to touch a cold, hot, or slippery container during carrying. The hands-free carrying option could benefit nature lovers/outdoorsmen who walk and hike, outdoor event attendees (such as concert goers or tailgaters), coffee drinkers on the go, food truck vendors, bookstore browsers, people caring children or pushing strollers, or any other user who wishes to have a beverage nearby in a hands-free manner. The beverage remains readily available for consumption when desired, but tasks can be performed in an easier manner.

Although exemplary designs of the portable beverage holder are shown and described, it should be understood that the product may be produced with varied shapes, styles, materials, or colors. Changes and modifications, additions and deletions may be made to the structures and methods recited above and shown in the drawings without departing from the scope or spirit of the disclosure or the following claims.

What is claimed is:

1. A portable beverage holder unit, comprising:

a beverage holding portion comprising an upper frame, a plurality of side portions, and a base;

at least one side portion in the plurality of side portions comprising an inner prong, the inner prong having a flexibility that causes it to extend inwardly and be biased in an upward direction, wherein insertion of a beverage depresses the prong inwardly such that the prong applies pressure to the beverage to hold it in place;

an adjustable rotator; and an attachment feature for securing the portable beverage holder unit to a user, wherein the adjustable rotator allows the beverage holding portion to be positioned at a desired angle with respect to the attachment feature and locked in place.

2. The unit of claim 1, wherein the inner prong is configured to be depressed upon insertion of a beverage container into the beverage holding portion.

3. The unit of claim 1, where in the adjustable rotator comprises a ratchet system.

4. The unit of claim 1, further comprising a canister accessory that functions as a side compartment.

5. The unit of claim 4, wherein the canister accessory is integrally formed along a side portion of the beverage holding portion.

6. The unit of claim 1, wherein each of the plurality of side portions comprises an inner prong.

7. The unit of claim 1, further comprising an feature configured to be positioned within the beverage holding portion or along an outer portion of the beverage holding portion.

8. The unit of claim 1, further comprising a counterweight.

9. The unit of claim 1, wherein the adjustable rotator is configured to remain in a disengaged position such that the beverage holding portion is allowed to swivel.

10. The unit of claim 4, wherein the canister accessory is separable from the portable beverage holder unit and is attached thereto via a cooperating T-rail and side channel configuration.

11. A portable beverage holder unit, comprising:

a beverage holding portion comprising an upper frame, a plurality of side portions, and a base;

at least one side portion in the plurality of side portions comprising an inner prong;

an adjustable rotator comprising a ratchet system; and an attachment feature for securing the portable beverage to a user, wherein the adjustable rotator allows the beverage holding portion to be positioned at a desired angle with respect to the attachment feature and locked in place, wherein the ratchet system comprises a gear element with teeth and a pin element configured to be engaged within a set of teeth in order to secure the beverage holding portion at the desired angle.

12. A portable beverage holder unit, comprising:

a beverage holding portion comprising an upper frame, a plurality of side portions, and a base;

at least one side portion in the plurality of side portions comprising an inner prong;

an adjustable rotator; and an attachment feature for securing the portable beverage to a user, wherein the adjustable rotator allows the beverage holding portion to be positioned at a desired angle with respect to the attachment feature and locked in place, further comprising a canister accessory, wherein the canister accessory comprises a securement feature and a corresponding securement feature on at least one of the plurality of side portions.

13. The unit of claim 12, wherein the securement feature comprises side channels and wherein the corresponding securement feature comprises a T-rail, wherein the side channels receive the T-rail.

14. The unit of claim 12, wherein the securement feature comprises a T-rail and wherein the corresponding securement feature comprises side channels, wherein the side channels receive the T-rail.

15. A portable beverage holder unit, comprising:

a beverage holding portion comprising an upper frame, a plurality of side portions, and a base;

at least one side portion in the plurality of side portions comprising an inner prong;

an adjustable rotator; and an attachment feature for securing the portable beverage to a user, wherein the adjustable rotator allows the beverage holding portion to be positioned at a desired angle with respect to the attachment feature and locked in place, further comprising a canister accessory, wherein the canister accessory comprises a lid.

16. The unit of claim 1, wherein the plurality of side portions meet at a lower support formed as a circular support.

* * * * *